US009931652B2

(12) United States Patent
Ferrarini

(10) Patent No.: US 9,931,652 B2
(45) Date of Patent: Apr. 3, 2018

(54) ROTARY JET NOZZLE

(71) Applicant: TECOMEC S.R.L., Reggio Emilia (IT)

(72) Inventor: Claudio Ferrarini, Modena (IT)

(73) Assignee: TECOMEC S.R.L., Reggio Emilia (IT)

( * ) Notice: Subject to any disclaimer, the term of this patent is extended or adjusted under 35 U.S.C. 154(b) by 0 days.

(21) Appl. No.: 15/018,456

(22) Filed: Feb. 8, 2016

(65) Prior Publication Data

US 2016/0228888 A1 Aug. 11, 2016

(30) Foreign Application Priority Data

Feb. 10, 2015 (IT) ..... 102015000005820

(51) Int. Cl.

*B05B 3/04* (2006.01)
*B05B 1/32* (2006.01)
*B05B 1/30* (2006.01)

(52) U.S. Cl.

CPC ..... *B05B 3/0463* (2013.01); *B05B 1/304* (2013.01); *B05B 1/3006* (2013.01); *B05B 1/32* (2013.01)

(58) Field of Classification Search

CPC ..... B05B 3/0463; B05B 1/3006; B05B 1/304; B05B 1/32
USPC ..... 239/104, 214, 214.19, 463, 538, 539
See application file for complete search history.

(56) References Cited

U.S. PATENT DOCUMENTS 5,002,230 A * 3/1991 Norskov ..... B05B 1/3006 137/513.5
7,118,051 B1 10/2006 Jager
8,500,042 B2 * 8/2013 Brown ..... B05B 3/0463 239/237

FOREIGN PATENT DOCUMENTS

EP 1832789 A2 9/2007
WO 2014023341 A1 2/2014

* cited by examiner

*Primary Examiner* — Arthur O Hall
*Assistant Examiner* — Viet Le
(74) *Attorney, Agent, or Firm* — Pearne & Gordon LLP

(57) ABSTRACT

A nozzle comprises:

a housing element, a chamber being defined inside the housing element for containing a fluid;

a rotor extending along a longitudinal axis, the rotor being arranged inside the housing element so that the longitudinal axis of the rotor is tilted relative to an axis of the housing element, the rotor having a conduit through which the fluid contained in the chamber can flow out of the nozzle.

The rotor is rotatably derivable about the axis of the housing element, so that the longitudinal axis of the rotor moves along a conical surface.

The nozzle further comprises an anti-drip device for selectively closing the conduit of the rotor, so that the fluid contained in the chamber is prevented from exiting through the conduit when the nozzle is inactive.

14 Claims, 2 Drawing Sheets

ROTARY JET NOZZLE

The invention relates to a rotary jet nozzle for dispensing a fluid jet on a surface, particularly a jet of a cleaning liquid such as water, in order to clean the surface on which the jet is being dispensed.

The rotary jet nozzle according to the invention can be particularly used as a dispensing element of a lance, for example on a high-pressure water jet machine. The rotary jet nozzle according to the invention is particularly suitable for professional uses.

Rotary nozzles are known which comprise a housing, internally of which a rotor is fitted, the rotor extending along a longitudinal axis that is tilted relative to an axis of the housing.

Inside the housing there is defined a chamber, in which the liquid can enter through an inlet hole and from which the liquid can exit through an outlet opening.

The rotor as well is provided with an inlet, through which the liquid that is present within the housing may enter inside the rotor, and with an outlet through which the liquid that is present inside the rotor can exit to the outside, by flowing through the outlet of the housing.

During operation, the liquid enters the chamber which is defined within the housing and causes the rotor to rotate about the axis of the housing. The liquid present inside the chamber enters the rotor via the corresponding inlet and afterwards exits therefrom towards the surface to be cleaned by flowing through the outlet of the rotor and the outlet opening of the housing.

A drawback of the rotary jet nozzles disclosed above is that leaks of liquid may occur while the nozzle is inactive. This is due to the fact that a certain amount of liquid remains inside the chamber even when the liquid is no more dispensed on the surface to be cleaned. In particular, the residual liquid present inside the chamber may enter the rotor and from there flow outwardly through the outlet of the rotor and the outlet opening of the housing.

The leaks of liquid mentioned above may be troublesome, since due to said leaks of liquid, the surface of the machine in which the nozzle is inserted or the surface to be cleaned, may become wet.

Additionally, during operation of the nozzles of the known type, pressure of the liquid present inside the chamber keeps the rotor in contact with a seat that is fixed relative to the housing. When the chamber is emptied due to the leaks of liquids during inactivity periods of the nozzle, the rotor becomes detached from its seat. If at this stage, the liquid is sent again into the chamber for performing cleaning operations, the rotor is pushed towards the seat thereof, thereby abutting against the latter with an impact which can also be rather severe due to liquid pressure. After long periods, this results in wear phenomena involving both the seat and the portion of the rotor that is impacting against the seat, which may cause breakage of the nozzle components in worst cases.

An object of the invention is to improve the rotary jet nozzles, particularly the nozzles which are suitable for dispensing a fluid such as a cleaning liquid on a surface to be cleaned.

A further object is to provide a rotary jet nozzle which allows to prevent, or at least minimize, the leaks of liquids occurring in known nozzles when the latter are inactive.

A further object is to reduce the risk of wetting again the already cleaned surfaces already once the cleaning operations have terminated, or to wet the surface of the machine in which the rotary jet nozzle is inserted.

Another object is to provide a rotary jet nozzle, in which wear phenomena are minimized, as well as risks of damage particularly due to impacts between the rotor and the seat thereof.

According to the invention, there is provided a nozzle comprising:

- a housing element, a chamber being defined inside the housing element for containing a fluid;
- a rotor extending along a longitudinal axis, the rotor being arranged inside the housing element so that the longitudinal axis of the rotor is tilted relative to an axis of the housing element, the rotor having a conduit through which the fluid contained in the chamber can flow out of the nozzle;

wherein the rotor is rotatably derivable about the axis of the housing element, so that the longitudinal axis of the rotor moves along a conical surface, and wherein the nozzle further comprises an anti-drip device for selectively closing the conduit of the rotor, so as to prevent the fluid contained in the chamber from exiting through said conduit when the nozzle is inactive.

Owing to the anti-drip device, leaks of fluid occurring while the nozzle is not active can be reduced. The anti-drip device indeed allows the conduit, which is obtained inside the rotor, to be closed during inactivity periods so that the fluid contained in the chamber is prevented from escaping through the conduit of the rotor to such an extent which may result in emptying of the chamber.

In this manner the risks are reduced of wetting the surface of the machine in which the nozzle is included, due to the fluid being spilled accidentally from the nozzle after that the nozzle has stopped working, or before starting cleaning operations. In addition, the risk is reduced of wetting again an already cleaned surface, due to the fluid being accidentally released from the nozzle.

In an embodiment, the rotor is fitted with interference internally of the housing element, so that a dispensing tip of the rotor is in contact with a seat which is fixed relative to the housing, and a rear end of the rotor is in contact with a contact surface which delimits the chamber transversely to the axis of the housing element.

The rotor is in this way packed between the seat and the contact surface mentioned above. Hence, the rotor cannot detach from the seat or from the contact surface, neither when the pressure of the fluid within the chamber is decreasing, nor if the chamber becomes completely emptied. However, as previously mentioned, owing to the anti-drip device through which the conduit of the rotor is closed when the nozzle is inactive, this latter event, i.e. The emptying of the chamber, does not occur during normal operation of the nozzle.

Repeated impacts between the rotor and the housing element are thus prevented, which results in wear reduction and improved nozzle life.

The invention will be better understood and implemented with reference to the appended figures, which illustrate a non-limiting example of one embodiment thereof, wherein.

Figure 1:
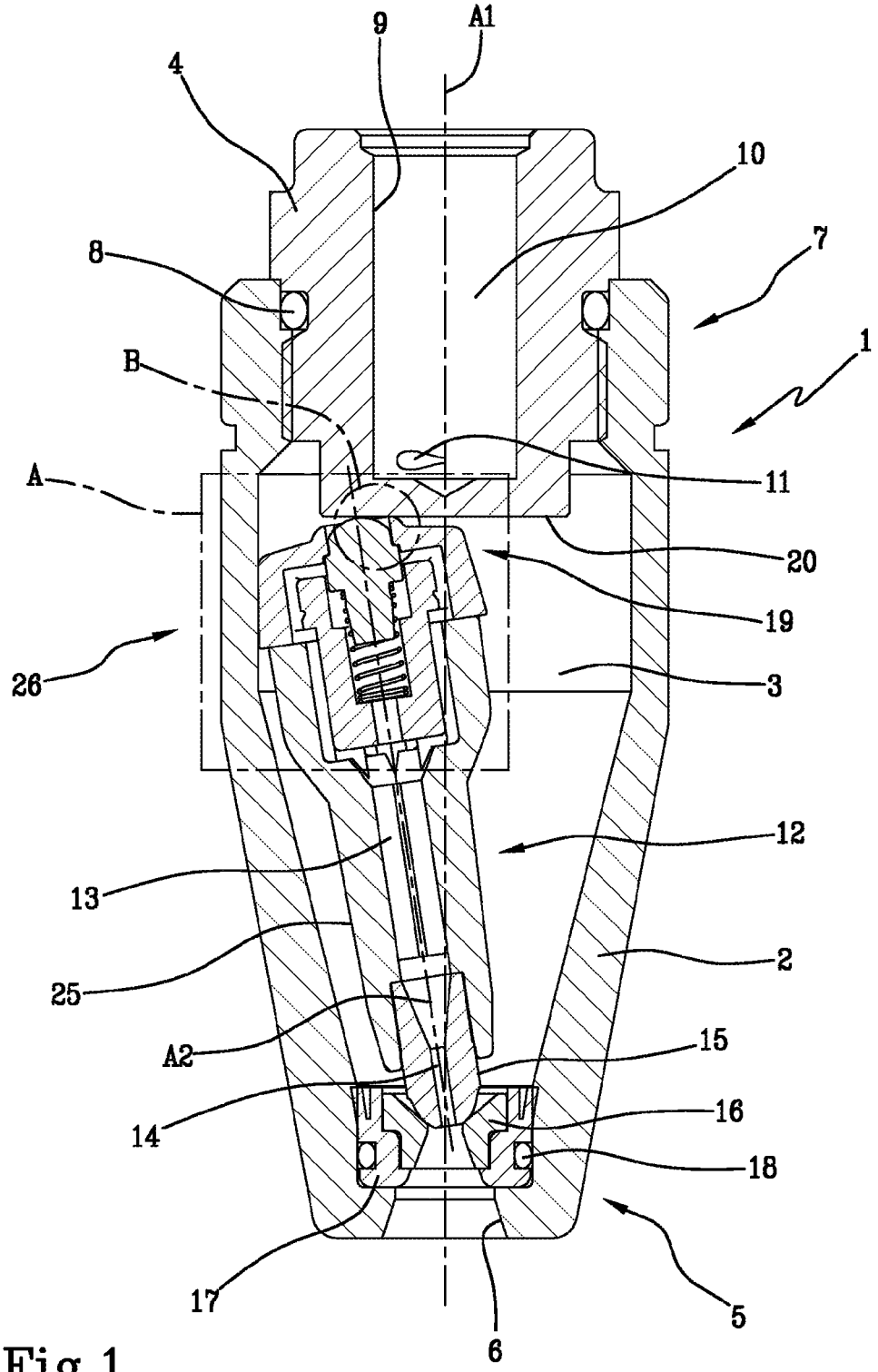
FIG. 1 is a cross-sectional view showing a rotary jet nozzle.

FIG. 1 shows a nozzle 1 of a rotary jet type, which is suitable for dispensing a fluid jet on a surface. The nozzle 1 is particularly suitable for being used in a cleaning apparatus, in which case the nozzle 1 is so arranged as to dispense a cleaning fluid, such as water, on a surface to be cleaned.

The nozzle 1 comprises a housing element 2 internally of which a chamber 3 is defined, the chamber 3 being suitable for containing the fluid. The housing element 2 extends along an axis A1, which may be an axis of symmetry of the housing element 2.

The housing element 2 has a first end 5, at which there is formed an outlet opening 6 through which the fluid may exit.

The housing element 2 further has a second end 7 opposite the first end 5. A closing element 4 engages in the second end 7, the closing element 4 being arranged to close the housing element 2 on the side of the second end 7. The closing element 4 is removably engaged with the housing element 2, e.g. Via a threaded connection. Between the closing element 4 and the housing element 2 a seal ring 8 may be interposed, the seal ring 8 being suitable for preventing leaks of fluid.

The closing element 4 is provided with a connection portion 9, which is suitable for being connected to a feeding device that is not shown, the feeding device allowing fluid to be fed to the nozzle 1. The feeding device may comprise for example the hose of a watering lance. In the example illustrated, the connection portion 9 comprises a threaded portion.

Inside of the closing element 4 there is defined a cavity 10 which is suitable to contain the fluid coming from the feeding device. A transverse hole 11 puts the cavity 10 in fluid communication with the chamber 3, the chamber 3 being defined inside the housing 2. The transverse hole 11, the function of which shall be better disclosed in a later section, extends transversely, in particular perpendicularly, to the axis A1 of the housing element 2. More particularly, the transverse hole 11 may be a hole which is tangentially directed relative to a hypothetical circumference centered on the axis A1 and lying on a plane perpendicular to such axis.

The nozzle 1 further comprises a rotor 12 arranged inside the chamber 3 and extending along a longitudinal axis A2, which is tilted with respect to the axis A1 of the housing element 2.

Internally of the rotor 12 there is obtained a conduit 13 through which the fluid contained in the chamber 3 may flow outside of the nozzle 1. The conduit 13 ends in an outlet hole 14 which is obtained in a dispensing tip 15 of the rotor 12. The dispensing tip 15 is arranged at a dispensing end of the rotor 12 and is delimited by an outer surface that can be a substantially hemispherical or frustum-conical surface.

The nozzle 1 further comprises a bushing 16, in which the dispensing tip 15 of the rotor 12 engages. The dispensing tip 15 is particularly arranged in contact with a seat or bearing surface of the bushing 16, which seat or bearing surface may for example have a frustum-conical shape.

The nozzle 11 further comprises a supporting element 17, which is fitted in a stationary position at the first end 5 of the housing element 2, in order to support the bushing 16. Between the supporting element 17 and the housing element 2 there is interposed a sealing element 18 for preventing leaks of fluid.

Both the bushing 16 and the supporting element 17 have a central hole, so that the fluid present inside the conduit 13 is allowed to flow outside of the nozzle 1 by flowing through the outlet hole 14 and the outlet opening 6.

During operation of the nozzle 1, the rotor 12 is rotatably movable about the axis A1 of the housing element 2. In particular, the rotor 12 is rotatably driven by the fluid flow entering the chamber 3 through the transverse hole 11. Such flow has a tangential component which acts on a rear end 19 of the rotor 12, so that the rotor 12 is rotated about the axis A1. The rear end 19 is opposite the dispensing tip 15. During this rotational movement, the longitudinal axis A2 of the rotor moves along a cone whose axis coincides with the axis A1 of the housing element 2.

The rotor 12 is fitted with interference inside the chamber 3. In other words, the rotor 12 has a length, which is measured in the direction of the longitudinal axis A2, such that, during rotation about the axis A1, the dispensing tip 15 is maintained in contact with the seat formed in the bushing 16, while the rear end 19 is maintained in contact with a contact surface 20 which defines the chamber 3 transversely to the axis A1. In the example shown, the contact surface 20 is flat and extends perpendicularly to the axis A1 The contact surface 20 particularly delimits a transverse wall of the closing element 4.

Figure 2:
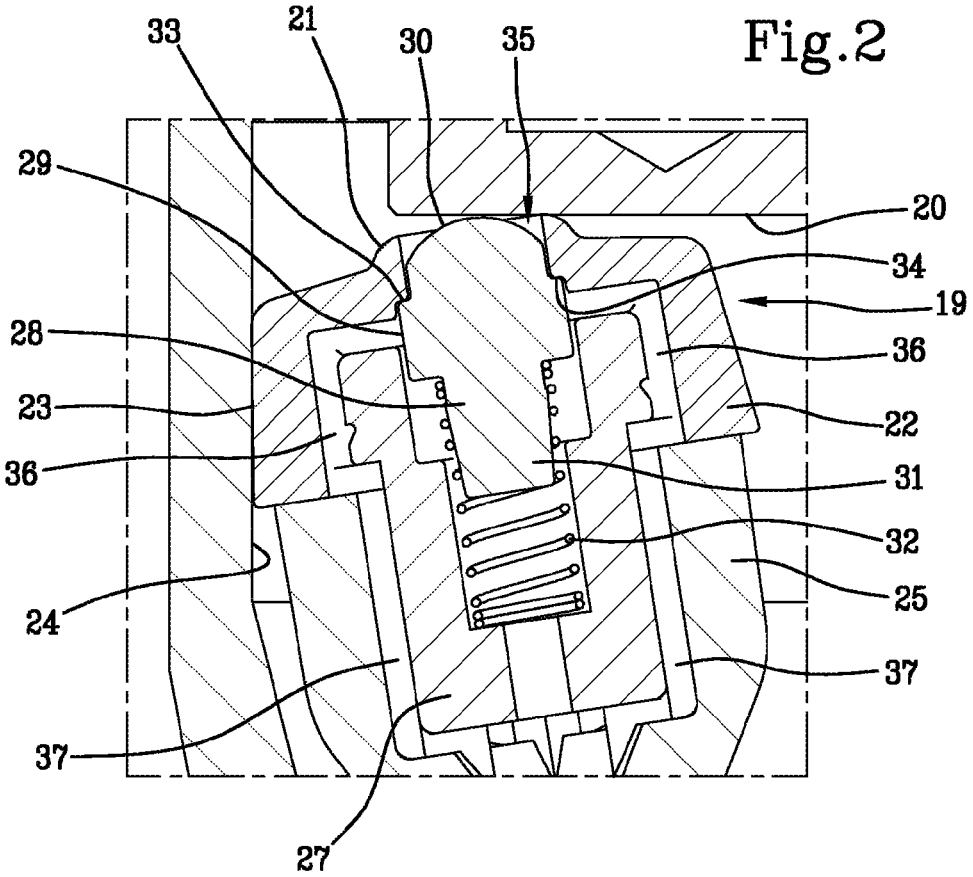
FIG. 2 is an enlargement of the detail "A" of FIG. 1.

As shown in FIG. 2, the rotor 12 may be provided with an annular protrusion 21 or collar, projecting at the rear end 19 so as to be in contact with the contact surface 20. The annular protrusion 21 minimizes the dimension of the zone in which the rotor 12 is in contact with the contact surface 20, so as to limit friction generated when the rotor 12 rotates. The annular protrusion 21 extends about the longitudinal axis A2 of the rotor 12.

In the example shown, the annular protrusion 21 is obtained in an end element 22 of the rotor 12. The end element 22 is delimited by a lateral surface 23 suitable for resting against an inner surface 24 of the housing element 2 while the rotor 12 rotates. The lateral surface 23 thus acts as a guiding surface which maintains the rotor 12 guided in its rotational movement about the axis A1. The lateral surface 23 is particularly shaped as a frustum-conical surface, whereas the inner surface 24 is substantially cylindrical.

The rotor 12 further comprises an intermediate element 25 which is interposed between the end element 22 and the dispensing tip 15.

The nozzle 1 comprises an anti-drip device 26 associated with the rotor 12 for selectively closing the conduit 13, so that passage of the fluid through the conduit 13 is prevented when the nozzle 1 is inactive. In the example illustrated, the anti-drip device 26 is provided at the rear end 19 of the rotor 12.

The anti-drip device 26 may comprise a valve, particularly a non-return valve, suitable for allowing passage of fluid from the chamber 3 towards the dispensing tip 15 of the rotor 12 when fluid pressure inside the chamber 3 exceeds a preset value. Hence, this valve is normally closed, so as to close the conduit 13 of the rotor 12, and is switched in an open position, so as to allow the fluid to flow through the conduit 13 and then exit outside, when the fluid pressure inside the chamber 3 exceeds the preset value mentioned above.

In particular, as shown in FIG. 2, the anti-drip device 26 comprises a body 27 which is housed internally of the rotor 12, particularly between the intermediate element 25 and the end element 22.

The anti-drip device 26 further comprises a shutter element 28, which is movable inside the body 27 between a closed position, shown in FIG. 2, and an open position that is not shown. In the open position, the chamber 3 is in fluid communication with the conduit 13, whilst in the closed position the fluid is prevented from flowing from the chamber 3 towards the conduit 13.

The anti-drip device 26 may further comprise an elastic element 32, acting on the shutter element 28 in order to keep it in the closed position. In the example shown, the elastic element 32 is conformed as a helical spring interposed between the shutter element 28 and the body 27.

The shutter element 28 may be mushroom-shaped. In particular, the shutter element 28 may comprise an intermediate portion 29 interposed between a head 30 and a shank 31.

The shank 31 is so dimensioned as to be inserted inside the elastic element 32, in such a manner that the elastic element 32 is compressed between a bottom wall of the body 27 and a step which is obtained on the shutter element 28.

Figure 3:
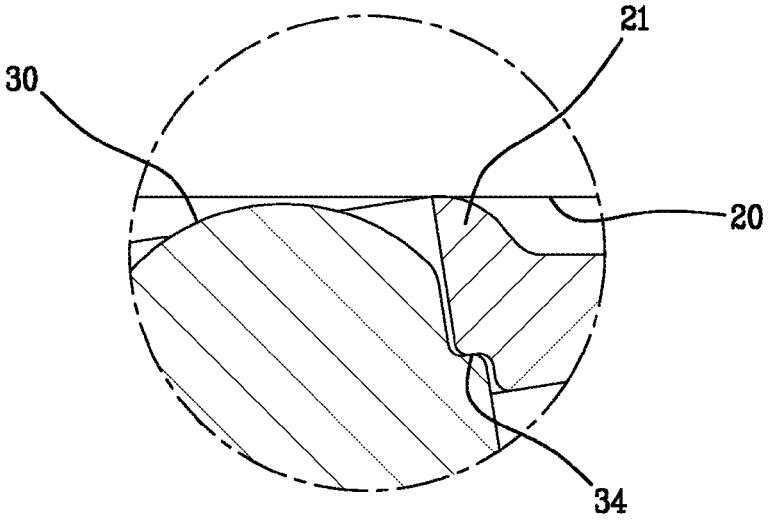
FIG. 3 is an enlargement of the detail "B" of FIG. 1.

The head 30 is suitable for facing the contact surface 20. In the example shown, the head 30 is shaped as a spherical cap, although further geometric shapes are possible. As shown in the detail of FIG. 3, in the closed position of the shutter element 28, the head 30 projects outwardly of the rotor 12 through a hole 35 obtained in the end element 22. The hole 35 is encircled by the annular protrusion 21.

The intermediate portion 29 has a diameter that is larger than the head 30 and the shank 31, so as to protrude radially towards the end element 22, in which the intermediate portion 29 is received.

Between the intermediate portion 29 and the head 30, a shoulder 33 may be identified in the shutter element 28, the shoulder 33 being suitable for abutting against an abutment surface 34 obtained in the rotor 12, particularly in the end element 22. In particular, the shoulder 33 encircles the head 30.

Between the end element 22 and the body 27 there is defined a plurality of passages 36, which continue into corresponding further passages 37 obtained between the body 27 and the intermediate element 25. The passages 36 each have a first portion directed transversely with respect to longitudinal axis A2 of the rotor 12 and a second portion parallel to the longitudinal axis A2. The further passages 37 each have an initial portion directed parallel to the longitudinal axis A2 and a final portion directed transversely to that axis, so as to open into the conduit 13.

The passages 36 and the further passages 37 allow the hole 35 to be put in fluid communication with the conduit 13, when the shutter element 28 is in the open position.

In the closed position, the elastic element 32 is pushing the shutter element 28 towards the contact surface 20, thereby causing the shoulder 33 to abut against the abutment surface 34; in this manner the hole 35 is closed, so that the fluid contained in the chamber 3 is prevented from reaching the conduit 13 thus flowing out from the nozzle 1.

In the open position, the fluid pressure inside the chamber 3 overcomes the resistance of the elastic element 32 and pushes the shutter element 28 inside the body 27. The shoulder 33 of the shutter element 28 moves away from the abutment surface 34 of the end element 22 and the fluid present inside the chamber 3 may enter the passages 36 by flowing through the hole 35, then enter the further passages 37 and finally reach the conduit 13 in order to flow out from the nozzle 1.

It is noted that the shutter element 28 is dimensioned such that, in the closed position thereof, the head 30 is spaced apart from the contact surface 20. The closed position of the shutter element 28 is the position in which the shutter element 28 mostly protrudes from the body 27. In other words, as shown in the detail of FIG. 3, in the closed position of the shutter element 28, the annular protrusion 21 of the rotor 12 is in contact with the contact surface 20, whereas between the contact surface 20 and the head 30, a predetermined clearance is defined. Any friction between the head 30 and the contact surface 20 is thus avoided.

During operation, the fluid is fed inside the nozzle 1 by means of the feeding device (not shown), at a preset pressure, which is possibly adjustable by an operator through a pressure adjustment device arranged upstream of the nozzle 1 and not illustrated. In particular, the fluid enters the cavity 10 of the closing element 4 and from here it flows into the chamber 3 through the transverse hole 11. Since the fluid is exiting from the transverse hole 11 along a tangential direction, the fluid exerts on the rotor 12 a force which rotates the rotor 12 about the axis A1 of the housing element 2. The transverse hole 11 may therefore be regarded as a driving element for rotatably driving the rotor 12, since the transverse hole 11 allows the fluid passing therethrough to exert on the rotor 12 a thrust which causes rotation of the rotor 12.

By flowing through the hole 11, the fluid reaches the chamber 3 in order to act on the shutter element 28 as well. The pressure inside the chamber 3 gradually increase, until the pressure inside the chamber 13 reaches a value at which the force acting on the shutter element 28 due to the pressurized fluid present inside the chamber 3, is sufficient to overcome the elastic resistance of the element 32. At this point, the shutter element 28 is switched to the open position and the shoulder 33 is detached from the abutment surface 34. The fluid which is present inside the chamber may thus enter the rotor 12 through the hole 35. In particular, this fluid flows through the space which is defined between the shoulder 33 and the abutment surface 34, and from there it reaches the passages 36 and the further passages 37. From the further passages 37, the fluid reaches the conduit 13, and flows out from the dispensing tip 15 of the rotor 12. By passing through the outlet opening 6 of the housing 2, the fluid exits outside the nozzle 1 in order to reach the surface to be cleaned. The fluid jet which is coming out from the rotor 12 and thus from the nozzle 1, is directed substantially along the longitudinal axis A2 of the rotor 12. Since, during rotation of the rotor 12, the longitudinal axis A2 rotates about the axis A1 of the housing element 2, the fluid jet coming out of the rotor 12 is a rotary jet, which allows the dimension of the surface contacted by the fluid jet to be increased.

When the fluid ceases to be sent inside the nozzle 1, pressure inside the chamber 3 progressively decreases, until such pressure is no longer sufficient to overcome the resistance of the elastic element 32 for maintaining the shutter element 28 in the open position. The elastic element 32 thus pushes the shutter element 28 towards the outside of the rotor 12, until the shoulder 33 is caused to abut against the surface 34. At this point, the conduit 13 is closed, i.e. it is no longer in fluid communication with the chamber 3, and the fluid ceases to be dispensed outside of the nozzle 1. The fluid which is present inside the hole 35 is in fact prevented from reaching the passages 36 due to the shoulder 33 being in contact with the abutment surface 34.

The anti-drip device 26 thus allows the conduit 13 to be selectively closed when the nozzle 1 is inactive, i.e. when the fluid ceases to be fed to the nozzle 1 and the pressure of the fluid inside the chamber 3 falls below a preset value. It is thus possible to avoid leaks of fluid from the chamber 3 to the outside of the nozzle 1 through the rotor 12, during inactivity periods of the nozzle 1, regardless of the orientation with which the nozzle is positioned.

Furthermore, since the dispensing tip 15 of the rotor 12 is constantly in contact with the bushing 16, the bushing 16 being fixed relative to the housing element 2, and since the annular protrusion 21 of the rotor 12 is constantly in contact with the contact surface 20, the fluid inside the chamber 3 is prevented from flowing out from the nozzle 1 by flowing between the dispensing tip 15 and the bushing 16, during inactivity periods of the nozzle 1.

The dimensional tolerances according to which the components of the rotor 12 are made are such that, when the annular protrusion 21 is in contact with the contact surface 20, the dispensing tip 15 is pushed against the bushing 16, thereby preventing the fluid from passing between the dispensing tip 15 and the bushing 16.

In this manner, when the nozzle 1 is inactive, any fluid leaks from the nozzle 1 outwards are minimized and indeed substantially prevented, which allows many of the drawbacks encountered by operators in traditional nozzles to be eliminated.

Furthermore, the rotor 12 is maintained in contact with the seat of the bushing 16 not due to the pressure exerted by the fluid inside the chamber 3 as was the case of prior art nozzles, but due to the dimensions of the rotor 12, and in particular due to the fact that the rotor 12 is fitted with interference inside the housing element 2. In this manner, the position of the rotor 12 along a direction parallel to the longitudinal axis A2 is not affected by pressure of the fluid which is present inside the chamber 3. This prevents impacts between the dispensing tip 15 and the bushing 16 when the fluid pressure in the chamber 3 decreases, also in the case in which the chamber 3 is completely emptied, for example due to breakage of the anti-drip device 26.

The invention claimed is:

1. A nozzle for dispensing a jet of a cleaning liquid on a surface, the nozzle comprising:

a housing element, a chamber being defined inside the housing element for containing the cleaning liquid;

a rotor extending along a longitudinal axis, the rotor being arranged inside the housing element so that the longitudinal axis of the rotor is tilted relative to an axis of the housing element, the rotor having a conduit through which the cleaning liquid contained in the chamber can flow out of the nozzle, the rotor further having a hole through which the cleaning liquid contained in the chamber can enter the rotor;

wherein the rotor is rotatably drivable about the axis of the housing element, so that the longitudinal axis of the rotor moves along a conical surface;

and wherein the nozzle further comprises an anti-drip device for selectively closing the conduit of the rotor, so as to prevent the cleaning liquid contained in the chamber from exiting through said conduit when the nozzle is inactive;

the anti-drip device comprising a body housed internally of the rotor and a shutter element movable inside the body between an open position and a closed position, the nozzle having a plurality of passages defined between the rotor and the body for putting in fluid communication the hole with the conduit in the open position of the shutter element.

2. A nozzle according to claim 1, wherein the anti-drip device comprises a normally closed valve, said valve being operable in an open position when pressure of the cleaning liquid contained in the chamber exceeds a pre-determined value, so as to open the conduit of the rotor.

3. A nozzle according to claim 1, wherein the rotor comprises a dispensing end facing an outlet opening of the housing element for dispensing outwardly the cleaning liquid coming from the conduit, and a rear end arranged opposite the dispensing end.

4. A nozzle according to claim 3, wherein the anti-drip device is provided at the rear end of the rotor.

5. A nozzle according to claim 3, wherein the rotor is delimited by a lateral frustum-conical surface near the rear end, the lateral frustum-conical surface extending around the longitudinal axis, a portion of the lateral frustum-conical surface being arranged in contact with an inner cylindrical surface of the housing element while the rotor rotates about the axis of the housing element.

6. A nozzle according to claim 1, wherein the rotor has a pre-determined length, and is fitted with interference inside the chamber.

7. A nozzle according to claim 6, wherein the rotor comprises a dispensing end facing an outlet opening of the housing element for dispensing outwardly the cleaning liquid coming from the conduit, and a rear end arranged opposite the dispensing end, said pre-determined length being such that the dispensing end of the rotor is in contact with a seat which is fixed relative to the housing, the rear end of the rotor being in contact with a contact surface which delimits the chamber transversely to the axis of the housing element.

8. A nozzle according to claim 7, wherein the rear end of the rotor is provided with an annular protrusion projecting towards the contact surface and touching said contact surface.

9. A nozzle according to claim 7, wherein said seat is obtained on a bushing.

10. A nozzle according to claim 1, wherein the anti-drip device further comprises an elastic element housed in the body for pushing the shutter element against an abutment surface of the rotor, so as to close the conduit of the rotor, said conduit being openable when the cleaning liquid contained in the chamber has a pressure such as to overcome the thrust exerted by the elastic element on the shutter element.

11. A nozzle according to claim 10, wherein:

the rotor has a pre-determined length, and is fitted with interference inside the chamber;

the rotor comprises a dispensing end facing an outlet opening of the housing element for dispensing outwardly the cleaning liquid coming from the conduit, and a rear end arranged opposite the dispensing end, said pre-determined length being such that the dispensing end of the rotor is in contact with a seat which is fixed relative to the housing, the rear end of the rotor being in contact with a contact surface which delimits the chamber transversely to the axis of the housing element;

the rear end of the rotor is provided with an annular protrusion projecting towards the contact surface and touching said contact surface; and the shutter element exhibits a head shaped as a spherical cap and housed inside the hole of the rotor, said hole being surrounded by said annular protrusion.

12. A nozzle according to claim 11, wherein the annular protrusion protrudes relative to the head, so that the head is at a distance from the contact surface.

13. A nozzle according to claim 11, wherein the shutter element comprises a shoulder surrounding the head, said shoulder being suitable for abutting against said abutment surface when the anti-drip device closes the conduit of the rotor.

14. A lance for a high-pressure water jet machine, the lance comprising a dispensing element for dispensing a jet of a cleaning liquid on a surface to be cleaned, the dispensing element including a nozzle comprising:

a housing element, a chamber being defined inside the housing element for containing the cleaning liquid;

a rotor extending along a longitudinal axis, the rotor being arranged inside the housing element so that the longitudinal axis of the rotor is tilted relative to an axis of the housing element, the rotor having a conduit through which the cleaning liquid contained in the chamber can flow out of the nozzle, the rotor further having a hole through which the cleaning liquid contained in the chamber can enter the rotor;

wherein the rotor is rotatably drivable about the axis of the housing element, so that the longitudinal axis of the rotor moves along a conical surface;

and wherein the nozzle further comprises an anti-drip device for selectively closing the conduit of the rotor, so as to prevent the cleaning liquid contained in the chamber from exiting through said conduit when the nozzle is inactive;

the anti-drip device comprising a body housed internally of the rotor and a shutter element movable inside the body between an open position and a closed position, the nozzle having a plurality of passages defined between the rotor and the body for putting in fluid communication the hole with the conduit in the open position of the shutter element.

* * * * *